US007389598B2

(12) United States Patent
Bunger et al.

(10) Patent No.: US 7,389,598 B2
(45) Date of Patent: Jun. 24, 2008

(54) SLIDING IDENTIFIER FOR FILE FOLDERS

(75) Inventors: Kevin Joseph Bunger, Colesville, NY (US); Dennen John Bunger, Clinton, NY (US)

(73) Assignee: Kevin J. Bunger

( * ) Notice: Subject to any disclaimer, the term of this patent is extended or adjusted under 35 U.S.C. 154(b) by 364 days.

(21) Appl. No.: 11/114,409

(22) Filed: Apr. 27, 2005

(65) Prior Publication Data

US 2006/0242869 A1 Nov. 2, 2006

(51) Int. Cl.
*B42F 21/00* (2006.01)

(52) U.S. Cl. ..... 40/359; 40/360; 40/661.03; 40/641

(58) Field of Classification Search ..... 40/359, 40/641, 661.03, 642.02, 661.08, 654.01, 40/360; 229/67.2; 283/36
See application file for complete search history.

(56) References Cited

U.S. PATENT DOCUMENTS

| | | | | |
|---|---|---|---|---|
| 1,562,622 | A * | 11/1925 | Dodge | 40/359 |
| 2,538,361 | A * | 1/1951 | Furrer | 40/359 |
| 2,679,846 | A | 6/1954 | Addison | |
| 3,039,470 | A | 6/1962 | Podner | |
| 3,164,917 | A * | 1/1965 | Harper | 40/641 |
| 3,590,511 | A * | 7/1971 | Heimann | 40/359 |
| 4,031,646 | A * | 6/1977 | de Nouel | 40/359 |
| 4,209,925 | A | 7/1980 | Brugmann | |
| 4,905,393 | A | 3/1990 | Laurie | |
| 5,311,685 | A | 5/1994 | Wyant | |
| 2003/0126779 | A1 * | 7/2003 | Sato et al. | 40/641 |
| 2006/0225322 | A1 * | 10/2006 | O'Leary et al. | 40/359 |

* cited by examiner

*Primary Examiner*—Lesley D. Morris
*Assistant Examiner*—Christopher E Veraa

(57) ABSTRACT

An identification system for file folders having a front panel and a rear panel with a fold therebetween forming a pocket into which paper may be placed includes a rail disposed in the vicinity of a top edge of the rear panel of the file folder and extending across a width thereof, and a tab, including a pocket for inserting a file identifier, supported in frictional engagement with the rail for sliding motion on the rail across the width of the file folder. This permits easy adjustment of tabs as file folders are inserted and removed.

5 Claims, 4 Drawing Sheets

FILE #1
50
51
53
55
57
59
61
63
65
67
69
71
73
75
77
79
15

SLIDING IDENTIFIER FOR FILE FOLDERS

BACKGROUND TO THE INVENTION

The present invention relates to the identification of files in general and more particularly to an improved identification system in which identifiers on file folders are moveable to accommodate the insertion of a new file folder into an existing set of file folders.

It is common practice to identify file folders, such as hanging file folders, using tabs. Currently, the tabs which label the folder are typically fixed to the folder by inserting both left and right ends of the lower portion of the tab into vertical "slots" (measuring less then 1 inch in length) which are cut into the inside of the folder. These slots are evenly space across the top inside portion of the folder, in one case about 11 of them, so that the tab can be located at a number of positions from left to right. In a filing system, a tab may be staggered with reference to the folders before and after it. Thus, the user easily sees all the labels.

However, a problem arises when the user want to add or remove (permanently) a folder. If, for example, a folder were added, and the label were put in order based on the preceding file folder, the label would be blocked from view because of the label on the folder in front of it. To maintain the order of the entire file (usually alphabetical or numerical order) and the neat appearance of the staggered nature of the file folders, numerous other tabs would have to be relocated by the cumbersome task of removing, repositioning and re-inserting the tabs which were in back of the newly inserted folder. This is due to the cascading effect one newly inserted folder has on the rest. The tabs therefore, have to go out of and then back into the folders.

There have been some attempts to provide movable or adjustable tabs in the past. For example, U.S. Pat. No. 4,905,393 to Laurie is entitled "Sliding File Tab and Compatible File Folder." However this is not truly a sliding tab. This is because it depends on an adhesive, which must be unstuck before the tab can be moved across the top of the folder and then 're-stuck'.

Another type of index tab is that shown in U.S. Pat. No. 3,164,917 to Harper. Here a clamp-type tab is disclosed. The tab has a pair of depending legs contacting over a substantial area and forming a nip. The legs are inserted over the top edge of the file folder, which is gripped between the two legs. Obviously, repositioning is possible by sliding or removing and replacing. However, as noted in Harper some such clamp-type tabs have difficulty being inserted over thick files. Furthermore, the legs can lose their gripping power with time and or be knocked of the edge of the file folder.

Thus, there is a need for an improved tab adjustment system which provides a simpler adjustment procedure, while still maintaining a reliable connection of the tab to the file folder when, for example, a new file folder is inserted and tab positions must be adjusted.

SUMMARY OF THE INVENTION

The present invention overcomes the deficiencies in the art by providing an identification system for file folders having a front panel and a rear panel with a fold therebetween forming a pocket into which paper may be placed includes a rail disposed in the vicinity of a top edge of the rear panel of the file folder and extending across a width thereof, and a tab, including a pocket for inserting a file identifier, supported in frictional engagement with the rail for sliding motion on the rail across the width of the file folder.

Thus, there are basically two components making up the mechanism of the present invention. First, is a rail that is formed in or is fastened to the top, rear panel of the file folder. The second is a tab (into which a label can be inserted) that is designed to match the rail in such a way as to slide back and forth across the top of the folder. There is sufficient friction between the rail and the tab so that the tap will stay in place once it is positioned in the desired location, but not so much friction as to make it difficult to move across the rail.

DETAILED DESCRIPTION

The embodiments described and illustrated herein are hanging file folders. These are only examples. It will be recognized that the system of the present invention is also applicable to other forms of file folders such as the simple manila file folders in widespread use.

Figure 1:
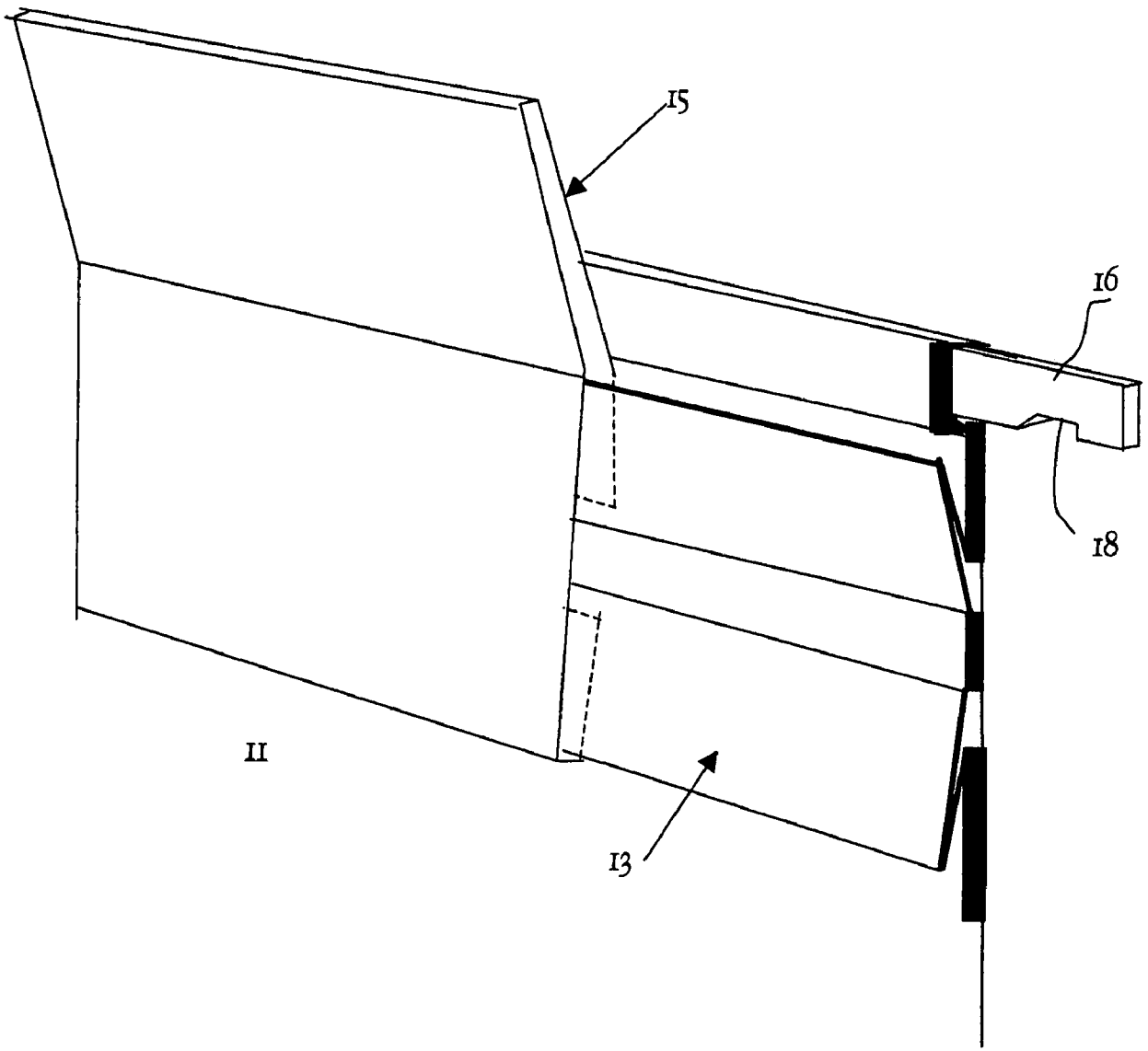
FIG. 1 is a perspective view of a first embodiment of the present invention in which a hanging folder is formed with longitudinally extending rail along which an identification tab holder can slide.

A first embodiment of the present invention implemented in a hanging folder 11 is shown in FIG. 1. In conventional fashion, along with other types of file folders, hanging file folder 11 has a front panel and a rear panel with a fold therebetween forming a pocket into which paper may be placed. In this case, being a hanging folder it also has longitudinal metal supports 16 with notches 18 at their ends to rest on guides in a file drawer. The two basic elements of the system of the present invention comprise a rail 13, disposed near to top of the inside of the rear panel of file folder 11, along which an identifying tab 15 can be mounted and easily slid across the top of the hanging folder 11. Sufficient friction between tab 15 and rail 13 is maintained so that, which sliding movement is not difficult, once slid to a position, the tab 15 will remain fixed on the rail 13. When new folders are added or if one or more existing folders are removed, necessitating the repositioning of tab 15, one need only slide the tab 15 to a new position along rail 13 into a new position. Adjustment of all tabs before or after the inserted file folder can be done to have readily visible staggered tabs 15. This can be done without removing the hanging folders from the file drawer.

Figure 3:
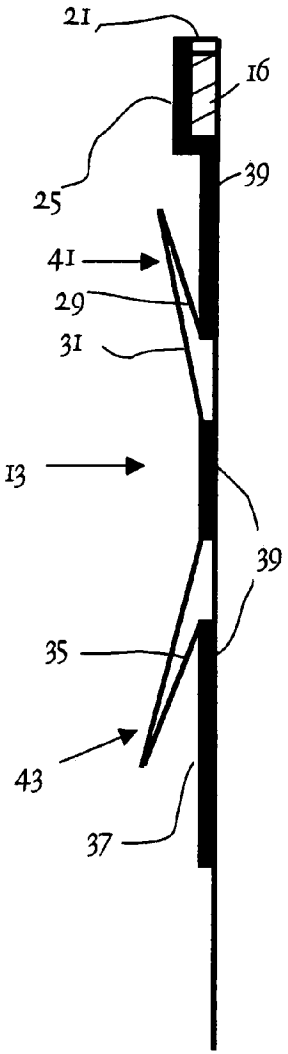
FIG. 3 is a side of the file folder of FIG. 2 with the folding completed and sections attached with adhesive to the rear panel of the file folder to form the rail.
Figure 2:
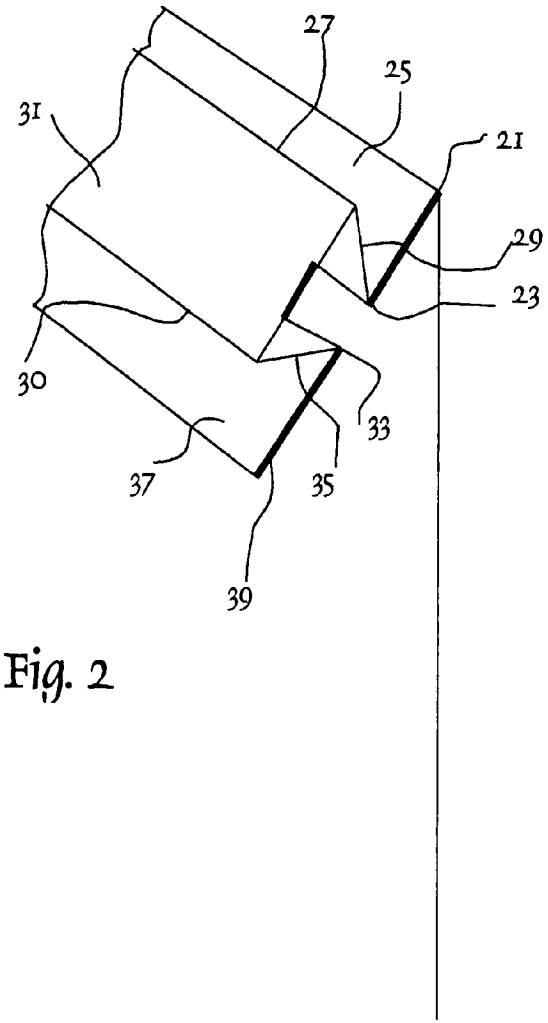
FIG. 2 is a perspective view showing how the upper portion of the rear panel of a file folder may be folded to form a rail.

The rail 13 can be incorporated in the folder 11 in a variety of ways. As illustrated in FIG. 1, it can be preformed and folded into the folder when the folder is manufactured. FIGS. 2 and 3 show the manner of obtaining an embodiment of such a preformed rail. As shown in FIG. 2, which is a perspective view showing the file folder before the folds are completed and attached to the inside rear panel surface of the file folder 11, a total of five folds are made. A first fold 21 is made folding an upper portion of the rear panel of file folder 11 back on itself. It is then folded in the opposite direction to obtain second fold 23 resulting in a first section 25 between folds 21 and 23. A third fold 27 in the direction opposite fold 23 defines second section 29. A fourth fold 30 is made in the same direction as fold 27, the two of them defining third section 31. Finally, a fifth fold 33 in the opposite direction defines fourth section 35 and leaves fifth section 37 remaining. Adhesive 39 is applied to the surfaces of first section 25, third section 31 (only in the central area) and fifth section 37 facing the inside surface 19.

The completion of the formation of the rail 13 is shown in the side view of FIG. 3. The metal hanger 15, also seen in FIG. 1 is inserted in the fold 21, after which section 25, to which adhesive 39 is applied, is applied against the inside rear panel surface of the file folder 11 to hold metal hanger 16 in place. Section 31 is pressed toward the inside rear panel surface of the file folder 11 and brought into contact therewith as is section 37. The adhesive 39 bonds sections 25, 37 and the center portion of section 31 the inside rear panel surface of the file folder 11. This results in the sections being compressed so that sections 29 and 31 form one rail section 41 and sections 35 and 31 form another rail section 43. Thus, rail 13 comprises a flat base formed by part of section 31 in contact with the rear panel and first and second rail sections 41 and 43 extending respectively outwardly and upwardly and outwardly and downwardly from the base.

Figures 4, 5, 6:
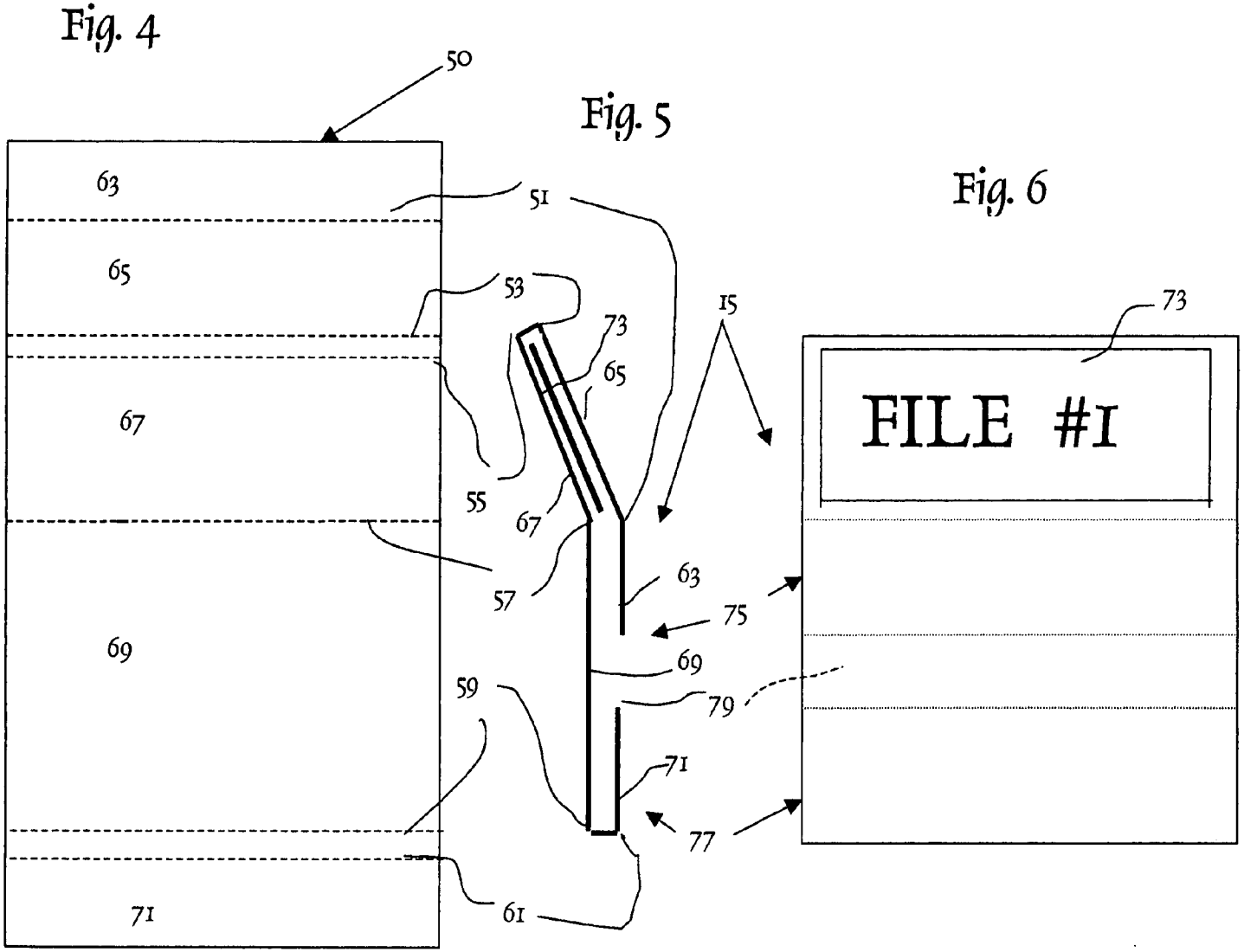
FIG. 4 is plan view of a sheet of plastic that can be formed into a tab to be used in the present invention showing the location of fold lines.
FIG. 5 is a side view of the tab resulting from folding the plastic sheet of FIG. 4 along the indicated lines.
FIG. 6 is a front plan view of the tab of FIG. 5.

The tab 14 can be made from a clear plastic material of the type from which current tabs are made. A rectangular sheet of clear plastic 50 is shown in FIG. 4. Fold lines 51, 53, 55, 57, 59 and 61 are indicated on the sheet. Lines 53 and 55 and lines 59 and 61 are closely spaced. The lines define areas 63, 65, 67, 69, and 71. The plastic sheet may be heated and folded along the fold lines into the shape shown in the side view of FIG. 5. The plastic is of a type which will, after being folded as shown when heated to make it more plastic, retain that form as it cools to a more rigid state. When folded, the areas 65 and 67 are closely adjacent and form a compartment into which a file designator 73 may be inserted. Areas 63 and 71 are substantially parallel to and spaced from area 69 and with area 69 form two channel areas 75 and 77 separated by a gap 79 on the side opposite area 69. A plan view of the finished tab 14 is shown in FIG. 6. The sizing of channels 75 and 77, i.e., the spacing of areas 63 and 71 from area 69 are selected based on the width and shape of rail sections 41 and 43 to establish the desired amount of friction between the rail 13 and the tab 15.

Figure 7:
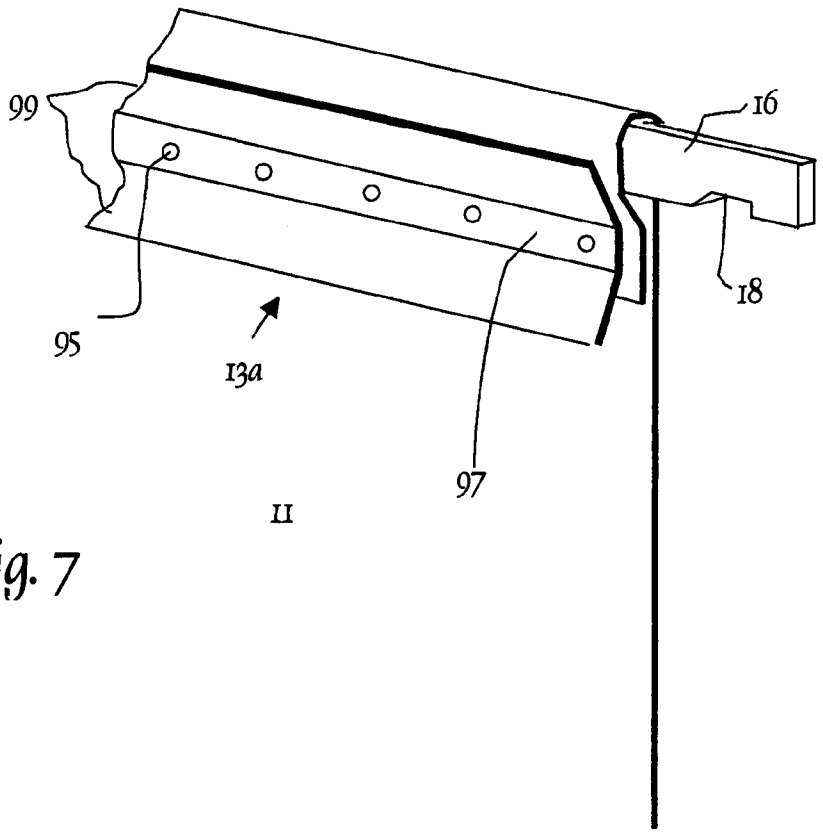
FIG. 7 is a perspective view of a second embodiment of the present invention in which a hanging folder includes longitudinally extending rail along which an identification tab holder can slide in which the rail is a separate element and is attached to the folder with mechanical fasteners.

Alternatively, as shown in FIG. 7, the rail 13*a* can be shaped from a light, stiff sheet material (plastic, metal of stiff cardboard) and mechanically fastened to the folder 11 with rivets 95, for example. Here, the rail is formed with a flat base 97 including holes through which the rivets are inserted and two legs 99 extending outwardly. Tab 15 slides on this rail 13*a* in the same manner as shown for rail 13 in FIG. 1.

Figure 8:
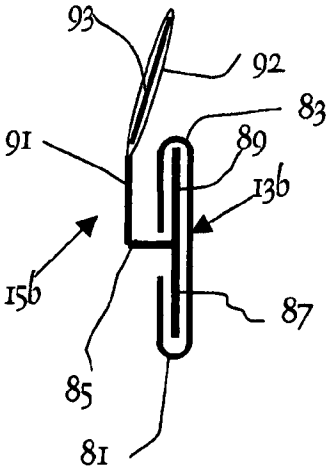
FIG. 8 is a cross-sectional side view illustrating an embodiment in which the rail attached to the file folder forms channels into which portions of T-shaped structure can slide in frictional engagement.

FIG. 8 shows a cross-section of a further embodiment of the present invention. In this embodiment a rail 13*b* is takes the form of a "C" with a flat base, which is attached to the rear panel of the file folder in any convenient fashion. The lower portion of a tab 15*b* shaped as a "T" is inserted into the rail 13*b* so as to frictionally engage to rail 13*b*. The C-shaped rail 13*c* forms upper and lower channels 83 and 81 receive the upper and lower parts 89 and 87 extending from the stem 85 of the "T". The stem is extended at an angle, shown in this embodiment as a right angle, upwardly as member 91. Member 91 has at its end a transparent plastic pocket 92 to receive a file identifier 93. Again, these parts may be formed of any suitable material such as plastic, metal, or stiff cardboard using conventional techniques known in the art.

The present invention is noted for the ease with which identifying tabs can be mounted to a hanging folder and most significantly, how their position relative to other tabs may be easily changed. This invention also allows other tabs to be easily mounted on the same rail, to provide a further categorizing of the material within the folder. The position of all tabs so mounted can be readily changed, simply by sliding them on the rail. This invention advances the "user friendliness" of hanging folders used for filing hard-copy information in offices both at work and home. Specifically, it provides an advance in the labeling device for the folder.

As noted above, it is possible to apply the present invention to the 'standard' or 'manila' type folders in addition to the hanging folder. These and other modifications can be made without departing from the spirit of the invention, which is intended to be limited solely by the appended claims.

What is claimed is:

1. An identification system for file folders having a front panel and a rear panel with a fold therebetween forming a pocket into which paper may be placed comprising:

a. a rail, made from a formed portion of the rear panel of the file folder, disposed on the inside in the vicinity of a top edge of the rear panel of the file folder and extending across a width thereof, said rail having a flat base in contact with said rear panel and first and second sections extending respectively outwardly and upwardly and outwardly and downwardly from said base; and b. a tab, including a pocket for inserting a file identifier, supported in frictional engagement with said rail for sliding motion on said rail across the width of the file folder, said tab formed with upper and lower channels frictionally engaging respectively said first and second sections and slidable therealong.

2. The identification system of claim 1 wherein said formed portion comprises:

a. A first fold comprising an upper portion of the rear panel of the file folder folded back on itself;

b. A second fold in the opposite direction resulting in a first section between the first and second folds;

c. A third fold in the direction opposite the second fold defining a second section;

d. a fourth fold in the same direction as the third fold and with it defining a third section;

e. a fifth fold in the opposite direction to the fourth fold defining a fourth section and leaving a fifth section remaining; and f. adhesive applied to the surfaces of first and fifth sections and to a central area of the third section facing an inside surface of the rear panel and bonding the first and fifth sections and the central area of the third section to the inside surface of the rear panel resulting in the sections being compressed so that second and third sections form said first rail section and the third and fourth sections form said second rail section.

3. The identification system of claim 2 wherein said file folder is a hanging folder and further including a metal hanger inserted in the first fold and maintained in place between said first section and the inside surface of said rear panel by said adhesive.

4. A method of forming a rail in a file folder having a front panel and a rear panel with a fold therebetween forming a pocket into which paper may be placed comprising:

a. forming a first fold by folding an upper portion of the rear panel of the file folder back on itself;

b. forming a second fold in the opposite direction resulting in a first section between the first and second folds;

c. forming a third fold in the direction opposite the second fold to define a second section;

d. forming a fourth fold in the same direction as the third fold and with it defining a third section;

e. forming a fifth fold in the opposite direction to the fourth fold to define a fourth section and leaving a fifth section remaining;

f. applying adhesive to the surfaces of first and fifth sections and to a central area of the third section facing an inside surface of the rear panel; and g. bonding the first and fifth sections and the central area of the third section to the inside surface of the rear panel to result in the sections being compressed so that second and third sections form said a rail section and the third and fourth sections form a second rail section.

5. The method of claim 4 wherein said file folder is a hanging folder and further including inserting a metal hanger in the first fold maintaining it in place between said first section and the inside surface of said rear panel with said adhesive.

* * * * *